US006672491B1

(12) United States Patent
Gugler

(10) Patent No.: US 6,672,491 B1
(45) Date of Patent: Jan. 6, 2004

(54) GARMENT HANGER

(76) Inventor: Donald Gugler, 10208 Swinton Ave., Granada Hills, CA (US) 91343

( * ) Notice: Subject to any disclaimer, the term of this patent is extended or adjusted under 35 U.S.C. 154(b) by 0 days.

(21) Appl. No.: 10/053,821

(22) Filed: Jan. 24, 2002

(51) Int. Cl.[7] ..... A41D 27/22
(52) U.S. Cl. ..... 223/88; 223/89; 223/94
(58) Field of Search ..... 223/88, 94, 84; 211/85.3, 94.01, 94.02, 162; 206/279, 89, 85.3

(56) References Cited

U.S. PATENT DOCUMENTS 915,340 A * 3/1909 Freeman ..... 211/85.3
1,127,782 A * 2/1915 Kurtzon ..... 211/85.3
2,061,156 A * 11/1936 Humphrey ..... 211/96
2,675,923 A * 4/1954 Humphrey ..... 211/96
2,814,426 A * 11/1957 Miller ..... 223/94
4,585,127 A * 4/1986 Benedict ..... 211/34
4,793,495 A * 12/1988 Preu ..... 211/13.1
5,031,782 A * 7/1991 Minervini ..... 211/46
6,068,166 A * 5/2000 Kilian et al. ..... 223/94

* cited by examiner

*Primary Examiner*—John J. Calvert
(74) *Attorney, Agent, or Firm*—Allan M. Shapiro

(57) ABSTRACT

The garment hanger has first and second shoulder bars and has first and second telescoping arms thereon which permit shoulder width adjustment of the garment hanger for proper support of garments having different shoulder width. In one configuration, the hanger is supported by a support tube on the top of the hanger, with the support tube telescopically engaging on an outwardly directed hanger anchor in the closet.

14 Claims, 2 Drawing Sheets

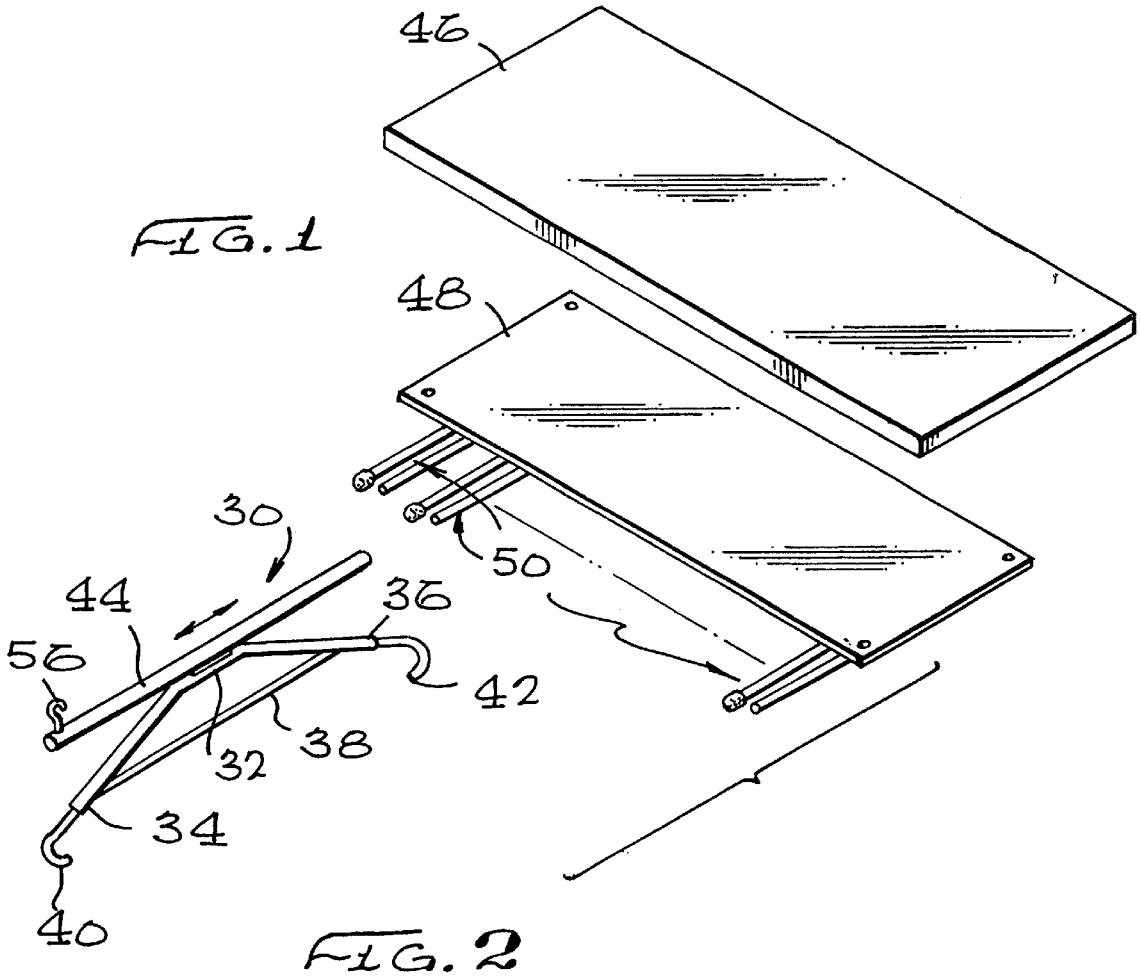
FIG. 1
FIG. 2
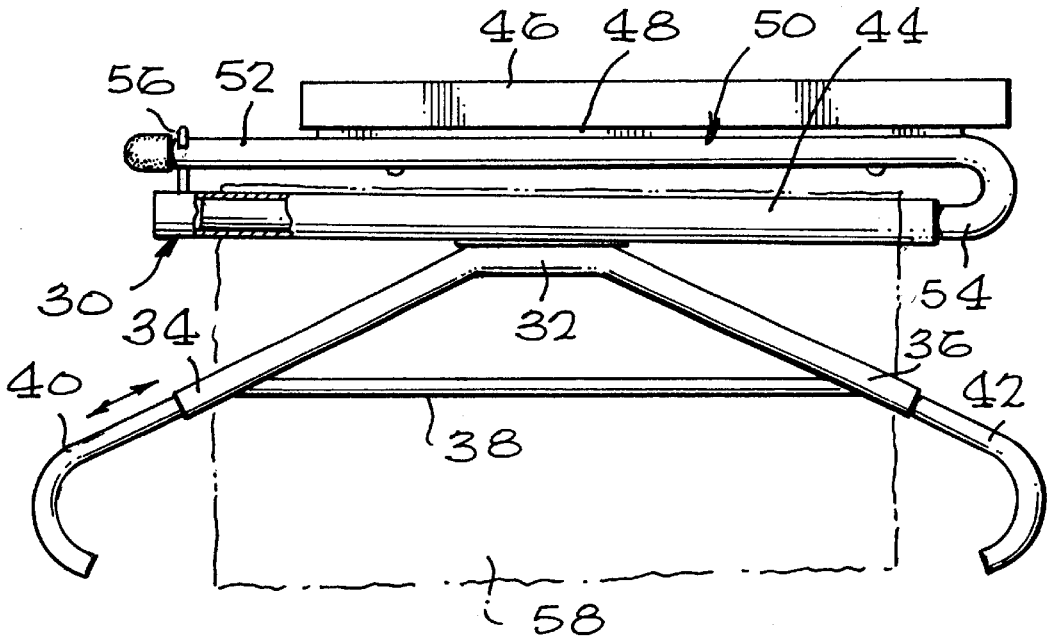

FIG. 3
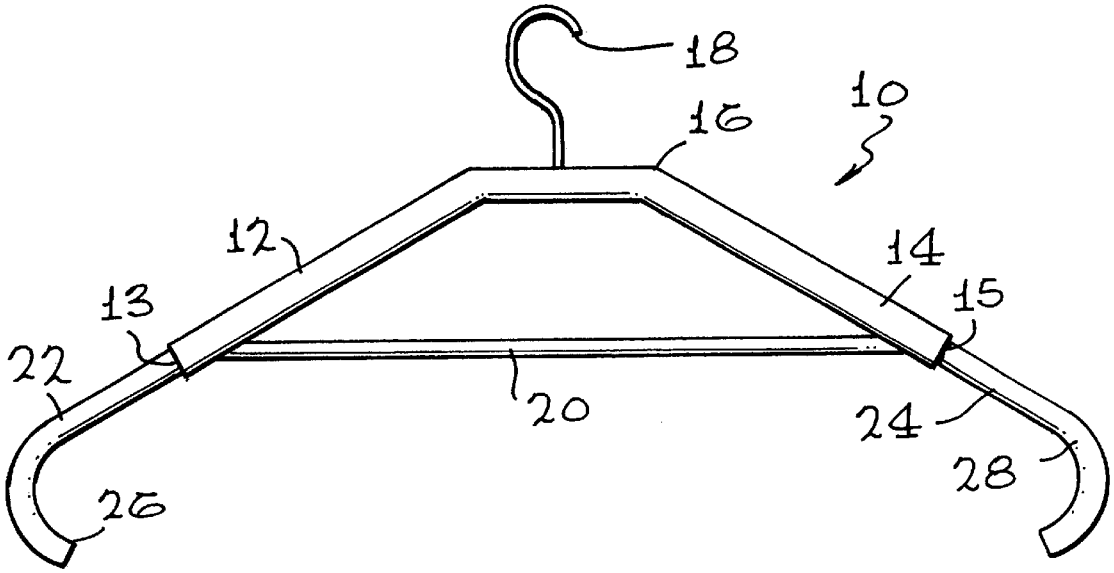
FIG. 4
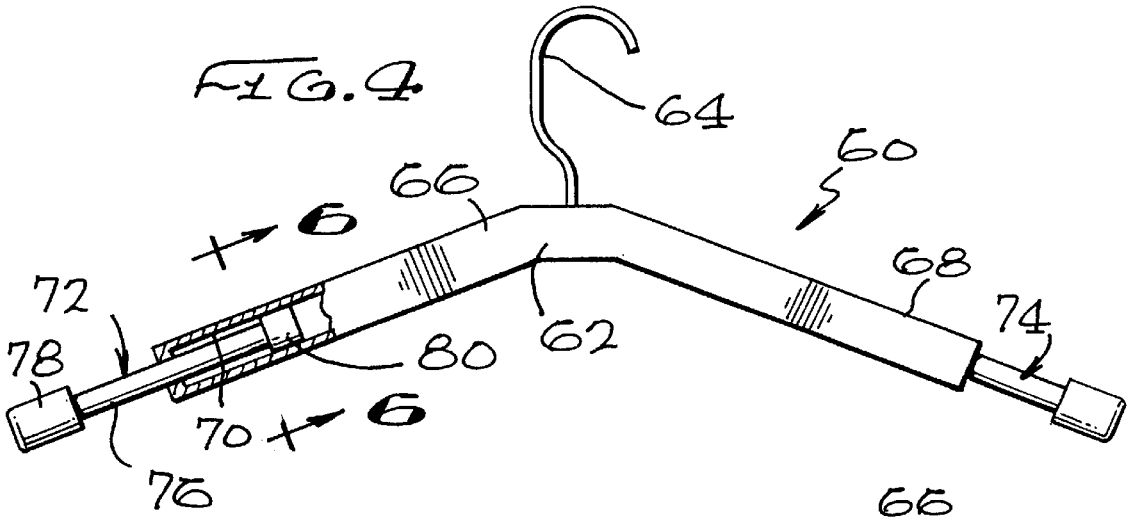
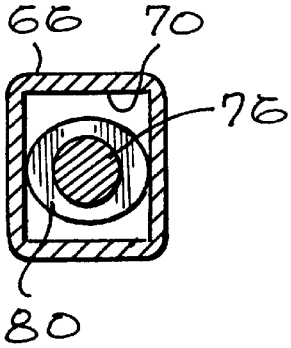
FIG. 6
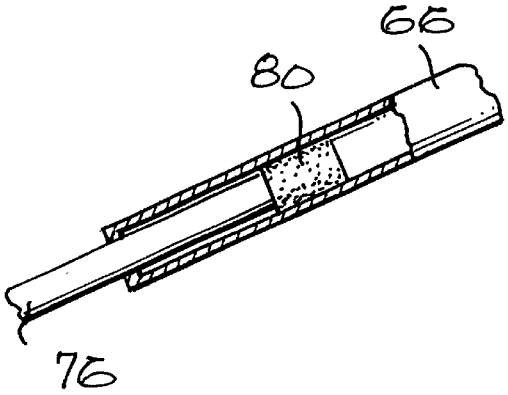
FIG. 5

GARMENT HANGER

FIELD OF THE INVENTION

This invention is directed to an improved garment hanger which has adjustable garment shoulder supporting hanger arms so that the hanger can be adjusted to garment size. In one configuration, the hanger is supported by a support tube on the top of the hanger engaging on an outwardly directed hanger anchor in the closet.

BACKGROUND OF THE INVENTION

In order to maintain the good condition of garments when they are not being worn, garment hangers have been created. Garment hangers have been produced in various shapes and styles. Garment hangers are usually constructed with shoulder portions for supporting the shoulders in coats, shirts and dresses of similar construction. Garment hangers often have a cross bar upon which can be hung trousers, skirts and other similar garments. The upper part of the hanger usually has a hook between the shoulder-supporting bars by which the hanger can be hung on a bar or the like. Though there have been many changes in the construction of garment hangers, most of the prior garment hangers do not properly fit the shoulder of the garment. There is a need for a garment hanger configured to be adjustable in length to properly support the shoulders of the garment to be hung thereon.

SUMMARY OF THE INVENTION

In order to aid in the understanding of this invention, it can be stated in essentially summary form that it is directed to a garment hanger which has garment shoulder supporting arms which are adjustable in length so that the garment hanger is suitable for garments of different sizes. In one configuration the garment hanger has a supporting tube above the support arms. This tube slides onto an outwardly-directed hanger anchor in the closet. The supporting tube is also suitable for hanging a skirt or trousers thereon.

It is thus a purpose and advantage of this invention to provide a garment hanger which has adjustable garment shoulder support arms so that the garment hanger can be adjusted to properly support garments of different shoulder widths.

It is another purpose and advantage of this invention to provide a garment hanger which is suitable for proper support of a shouldered garment, together with an additional garment such as skirt or trousers.

It is a further purpose and advantage of this invention to provide a garment hanger which can carry a garment on an upper tube with that tube also serving as a support for the garment hanger.

The features of this invention which are believed to be novel are set forth with particularity in the appended claims. The present invention, both as to its organization and manner of operation, together with further objects and advantages thereof, may be best understood by reference to the following description, taken in conjunction with the accompanying drawings.

BRIEF DESCRIPTION OF THE DRAWINGS

FIG. 1 is a perspective view of the first preferred embodiment of the garment hanger of this invention, showing one garment hanger in association with the hanger anchor provided in the closet for supporting the garment hanger.

FIG. 2 is an enlarged side elevational view thereof, with parts broken away and parts taken in section.

FIG. 3 is a side elevational view of a second preferred embodiment of the garment hanger of this invention.

FIG. 4 is a side elevational view, with parts broken away and parts taken in section, of a third preferred embodiment of the garment hanger of this invention.

FIG. 5 is an enlarged broken-away portion of the section portion of FIG. 4.

FIG. 6 is an enlarged transverse section taken generally along line 6—6 of FIG. 4.

DESCRIPTION OF THE PREFERRED EMBODIMENTS

The garment hanger 10 shown in FIG. 3 has first and second tubular shoulder bars 12 and 14 angled downward from the center bar 16 at a conventional angle which is configured to engage within a garment having shoulder structure. The downward angle is chosen to best support the usual garment. The center part 16 spaces the shoulder bars and hook 18 is secured thereto. The hook is sized to be able to engage over a conventional closet bar. Cross bar 20 is secured to both shoulder bars adjacent their lower outer ends. A convenient structure for the portion of the garment hanger 10 thus described is making the shoulder bars and center bar out of one piece of tubular synthetic polymer composition material. The crossbar is also of such tubular material, but may be of a smaller diameter, as shown.

In order to provide adjustability of the garment hanger 10 for garment shoulders of different width, first and second telescoping arms 22 and 24 are provided. These arms are sized to fit within the tubular openings in the shoulder bars 12 and 14, respectively. They are of a suitable tight fit to permit adjustment, but are held in place by the friction of the fit. The outer ends of the telescoping arms 22 and 24, respectively, are provided with curved ends 26 and 28 which are curved more than 90° in order to prevent causing distortion in the garment which is hung thereon. The telescoping arms are pulled out or pushed in to provide the proper total overall hanger width for the garment in question. A large man's jacket would require a larger overall width for proper support than a smaller woman's jacket. The arms of hanger 10 can be adjusted to properly accommodate either.

The garment hanger 30 shown in FIGS. 1 and 2 is similar to the garment hanger 10. It has a center bar 32 to which are attached, or with which are unitarily formed, left and right shoulder bars 34 and 36. The shoulder bars are strengthened with respect to each other by means of crossbar 38. At least the outer ends of the left and right shoulder bars are tubular and telescoping arms 40 and 42 are adjustably mounted therein. Again, the telescoping arms can be moved in and out of the shoulder bars and there is a friction fit therebetween which holds the telescoping arms in place, when suitably adjusted. This permits the garment hanger 30 to be adjusted to the shoulder width of the garment to be hung thereon and supported thereby.

The support of the garment hanger 30 in the closet is different. Attached to the center bar 32 is a support tube 44 which is in the same plane as the shoulder bars 34 and 36. The support tube is about as long as the width between the ends of the shoulder bars, as seen in FIG. 2. The garment hanger 30 is supported in a garment storage location. As one example, a shelf 46 is positioned in a garment storage location, such as a closet. Mounting plate 48 is mounted under the shelf 46 by means of screws, or the like. A plurality of U-shaped hanger anchors is secured under the mounting plate, parallel to each other and in spaced relationship, as seen in FIG. 1. Hanger anchor 50 is one of the hanger anchors shown in FIG. 1 and is shown in more detail in FIG. 2. The U-shaped hanger anchor 50 has an upper leg 52 by which the hanger anchor is attached to the mounting plate 48. Hanger anchor 50 also has a lower leg 54 which extends freely to the left, as seen in FIG. 2. The upper and lower legs 52 and 54 are parallel and are spaced from each other and are joined at a bend at the right end. The lower leg 54 is of uniform thickness throughout its length and is sized to be received within the support tube 44 on the garment hanger 30.

Thus, the garment hanger can be slipped onto the lower leg of the hanger anchor into the storage position shown in FIG. 2. Support hook 56 is attached to the support tube 44 adjacent its outer end as shown in FIG. 1. When the garment hanger is fully engaged on the lower leg 54, the hook 56 engages over the outer end of upper leg 52 as seen in FIG. 2 to provide additional weight-bearing support for the hanging elements of the garment hanger 30. In the hanger 10 in FIG. 3, the trousers or skirt associated with the shoulder garment can be hung over the crossbar 20. When using the garment hanger 30, the shoulder garment is first placed on the shoulder bars and then the trousers or skirt are placed over the support tube 44 as illustrated by the garment 58 shown in dashed lines in FIG. 2. This provides a greater length of straight support structure than is provided by the shorter crossbar 38.

Garment hanger 60 shown in FIGS. 4, 5 and 6 is similar to the garment hanger 10. The garment hanger 60 has a center bar 62 which carries a hook 64 by which the hanger can be supported from a closet bar or the like. Left and right shoulder bars 66 and 68 are joined to the center bar and extend downward at an appropriate angle for a garment hanger. As seen in FIGS. 4, 5 and 6, the shoulder bars are tubular. As seen in FIG. 6, the shoulder bars have an irregular interior opening 70, such as a rectangular opening.

In the garment hanger 60 the telescoping arms 72 and 74 are formed of a rod 76 with an outer cap 78 thereon. The rod and cap are of circular cross section. The lock member 80 is attached to the inner end of the rod 76 of the telescoping arm 72. The lock member is noncircular but it is sized so that, when at one rotative position, the telescoping arm is free to move in and out and, in another rotative position, the telescoping arm is locked in position. This can be accomplished easily when the lock member is not round, such as the elliptical form shown. The major dimension of the elliptical lock member is larger than the distance between the walls of the opening 70 in a first direction and smaller than the distance between the walls of the opening 70 in a second direction at an angle to the first direction; as illustrated, the first and second directions are respectively horizontal and vertical. The material of the lock member is flexible and high friction, such as rubber, so that it can be rotated into a position wherein the lock member engages by friction on the walls of the opening 70 to hold the telescoping arm in the selected position. In order to enhance the appearance, the center bar and shoulder bars can be made of wood. Similarly, the caps and rods of the telescoping arms can be made of wood.

In each of these configurations the telescoping arms can be adjusted to the shoulder width of the jacket or dress to be hung thereon. This provides proper shoulder support for the garment so that the shoulders do not sag or are not stretched out. Superior clothing storage of these hangers is achieved.

This invention has been described in its presently contemplated best modes and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A garment hanger comprising:

first and second oppositely directed shoulder bars, said shoulder bars being angularly downwardly directed so as to be suitable for hanging a shouldered garment thereon, said first and second shoulder bars respectively having first and second ends which define the width across said shoulder bars;

support structure connected to said shoulder bars for supporting said shoulder bars;

first and second telescoping arms, said first and second telescoping arms being respectively in telescoping interconnection with said first and second shoulder bars so that said telescoping arms can be moved outward to provide garment shoulder support of greater width than said width across said shoulder bars;

said support structure comprising a support tube secured to said shoulder bars and a leg onto which said support tube is engaged in sliding relationship and hanger anchor structure for holding up said leg.

2. The garment hanger of claim 1 wherein said leg is the lower leg of a U-shaped hanger anchor having an upper leg and a lower leg and there is attachment structure on said upper leg for attaching said upper leg to the underside of a shelf or the like and said lower leg is sized to receive said support tube thereon.

3. The garment hanger of claim 2 wherein said lower leg of said hanger anchor is spaced sufficiently from said upper leg to permit hanging of a garment over said support tube and engaging said support tube over said upper leg, without the garment being disturbed by said upper leg of said hanger anchor.

4. The garment hanger of claim 1 wherein said shoulder bars are tubular and said telescoping arms slide into said tubular shoulder bars to permit width adjustment of said garment hanger.

5. A garment hanger comprising:

first and second shoulder bars, said first and second shoulder bars being directed away from each other and being secured together, said shoulder bars being angularly directed so as to be suitable for the engagement thereon of the shoulders of a garment, said shoulder bars having ends which determine the width across said shoulder bars, said shoulder bars being tubular and being open at said ends;

first and second telescoping arms respectively telescoped within said tubular shoulder bars, said telescoping arms being positionable so that they extend out of said first and second shoulder bars so as to increase the effective width of said garment hanger to support garments having wider shoulders;

said first and second telescoping arms respectively having lock structure thereon so that they can be locked in a selected extended position.

6. The garment hanger of claim 5 wherein each of said tubular shoulder bars has a non-circular tubular opening therein and said lock structure locks within said non-circular tube by rotating therein to lock and unlock said telescoping arm with respect to said shoulder bar.

7. The garment hanger of claim 6 wherein said lock structure is a rubber-like member secured to said telescoping arm.

8. The garment hanger of claim 7 wherein said telescoping arms have curved ends to avoid creasing of garments supported thereon.

9. A garment hanger comprising:

first and second shoulder bars, said first and second shoulder bars being directed away from each other and being secured together, said shoulder bars being angularly directed so as to be suitable for the engagement thereon of the shoulders of a garment, said shoulder bars having ends which determine the width across said shoulder bars, said shoulder bars being tubular and being open at said ends;

first and second telescoping arms respectively telescoped within said tubular shoulder bars, said telescoping arms being positionable so that they extend out of said first and second shoulder bars so as to increase the effective width of said garment hanger to support garments having wider shoulders;

said support structure comprising a support tube secured to said shoulder bar and there is a hanger anchor, said hanger anchor having an upper leg and a lower leg, said upper leg being for attachment for support and said lower leg being configured to receive said support tube on said garment hanger so that said support tube can be moved on and off said lower leg.

10. The garment hanger of claim 9 wherein said support tube has a hook thereon, said hook being configured to engage over said upper leg when said support tube is engaged on said lower leg.

11. The garment hanger of claim 9 wherein said upper and lower legs are sufficiently spaced from each other so that a garment may be hung over said support tube and said support tube can be engaged on said lower leg of said support bar without the garment engaging on said upper leg.

12. The garment hanger of claim 11 wherein said support tube has a hook thereon, said hook being configured to engage over said upper leg when said support tube is engaged on said lower leg.

13. The garment hanger of claim 5 wherein said shoulder bars and said telescoping arms are made of wood.

14. The garment hanger of claim 5 wherein said shoulder bars and said telescoping arms are made of synthetic polymer composition material.

* * * * *